US012285094B2

(12) United States Patent
Reisbeck

(10) Patent No.: US 12,285,094 B2
(45) Date of Patent: Apr. 29, 2025

(54) DEVICE FOR SHARPENING AND CLEANING A SHAVING DEVICE WITH A RAZOR BLADE MOUNTED IN A RAZOR BLADE UNIT

(71) Applicant: Tilman Reisbeck, Dornstetten (DE)

(72) Inventor: Tilman Reisbeck, Dornstetten (DE)

( * ) Notice: Subject to any disclaimer, the term of this patent is extended or adjusted under 35 U.S.C. 154(b) by 574 days.

(21) Appl. No.: 17/437,901

(22) PCT Filed: Mar. 6, 2020

(86) PCT No.: PCT/DE2020/100157
§ 371 (c)(1),
(2) Date: Sep. 10, 2021

(87) PCT Pub. No.: WO2020/187359
PCT Pub. Date: Sep. 24, 2020

(65) Prior Publication Data

US 2022/0142329 A1 May 12, 2022

(30) Foreign Application Priority Data

Mar. 18, 2019 (DE) ..... 10 2019 106 889.4

(51) Int. Cl.
*A45D 27/46* (2006.01)
*B24D 15/08* (2006.01)
*B24D 15/10* (2006.01)

(52) U.S. Cl.
CPC ..... *A45D 27/46* (2013.01); *B24D 15/088* (2013.01); *B24D 15/10* (2013.01)

(58) Field of Classification Search
CPC ..... A45D 27/46; B24D 15/06; B24D 15/10; B24D 15/105
USPC ..... 30/35–37
See application file for complete search history.

(56) References Cited

U.S. PATENT DOCUMENTS 1,521,714 A * 1/1925 Quintal ..... B24D 15/088 76/DIG. 9
1,588,322 A * 6/1926 McAdoo ..... B24D 15/085 451/364
1,934,139 A * 11/1933 Pavitt ..... B24D 15/105 451/556

(Continued)

FOREIGN PATENT DOCUMENTS

CN 204711850 U 10/2015
CN 208390545 U 1/2019

(Continued)

OTHER PUBLICATIONS

International Search Report, issued in PCT/DE2020/100157, dated Jun. 9, 2020.

*Primary Examiner* — Adam J Eiseman
*Assistant Examiner* — Richard D Crosby, Jr.
(74) *Attorney, Agent, or Firm* — Birch, Stewart, Kolasch & Birch, LLP

(57) ABSTRACT

A device for sharpening and cleaning a shaving device with a razor blade mounted in a razor blade unit includes a main body and a strip-type leather section. This should significantly increase the lifespan or useful life of a razor blade unit of this type, it is economical to produce and can be easily handled in the practical application. This is achieved in that the main body also includes a liquid reservoir that can be compressed with the application of pressure.

20 Claims, 2 Drawing Sheets

(56) References Cited

Figure 1:
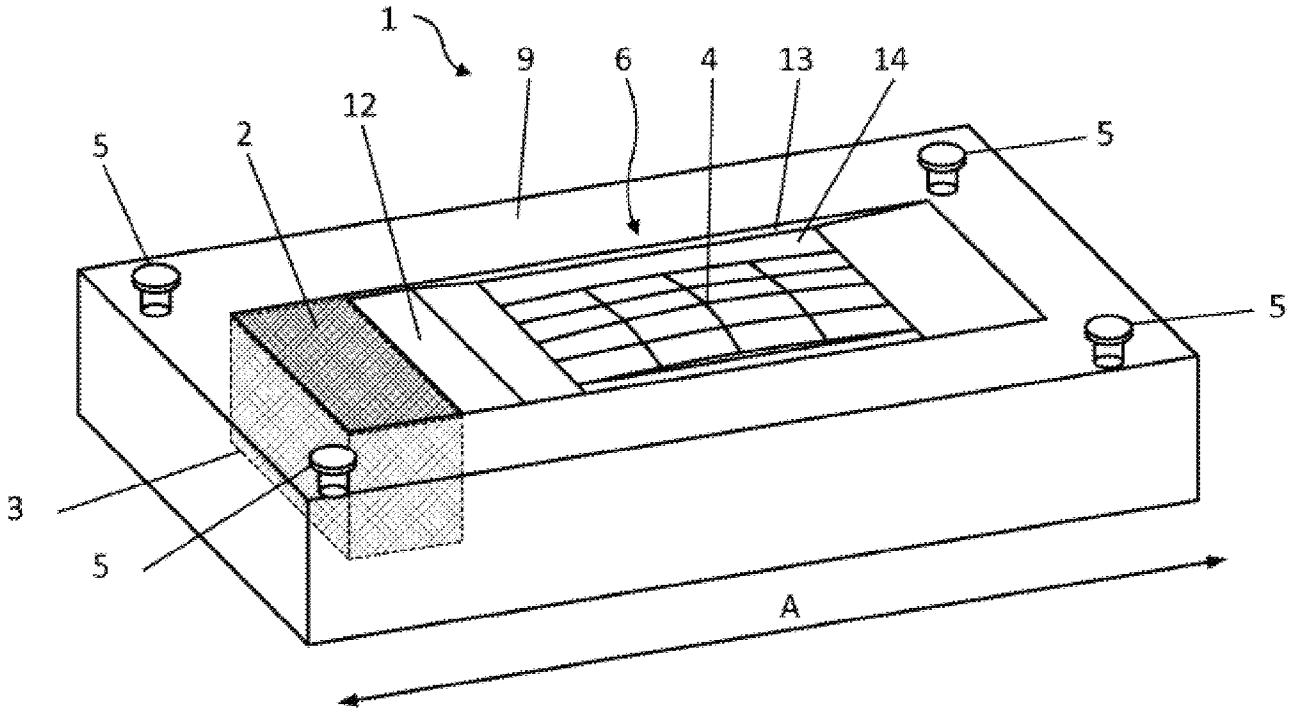

U.S. PATENT DOCUMENTS 2,278,553 A * 4/1942 Morrow ..... B24D 15/088 235/60 MT
4,759,153 A * 7/1988 Cohen ..... B24D 15/08 76/89.1
4,967,517 A * 11/1990 Mitchell ..... A47L 25/02 451/523
5,036,731 A * 8/1991 Fletcher ..... B24D 15/10 76/82
5,139,138 A * 8/1992 Isaksen ..... B26B 21/06 451/442
5,239,785 A * 8/1993 Allen ..... B24D 15/066 15/210.1
5,319,852 A * 6/1994 Metzger ..... A45D 27/29 D28/47
5,329,699 A * 7/1994 McCoy ..... B26B 21/40 30/34.05
5,785,586 A * 7/1998 Delsignore ..... B24D 15/10 451/36
5,941,761 A * 8/1999 Nagahara ..... B24B 53/017 451/461
6,030,281 A * 2/2000 Cozzini ..... B24B 41/06 451/320
6,062,970 A * 5/2000 Back ..... B24D 15/10 76/82
6,506,106 B2 * 1/2003 Fletcher ..... B24B 3/48 451/163
6,663,096 B2 * 12/2003 Heath ..... B24D 15/081 451/364
7,547,244 B2 * 6/2009 Fletcher ..... B24B 1/04 451/8
7,553,218 B2 * 6/2009 Morita ..... B24D 15/10 76/82
8,074,535 B2 * 12/2011 Martell ..... B24D 15/10 76/82
8,246,422 B2 * 8/2012 Andersen ..... B24D 15/10 451/523
8,627,747 B2 * 1/2014 Martell ..... B24D 15/10 76/82
10,986,979 B2 * 4/2021 Sullivan ..... A47L 13/16
11,691,307 B2 * 7/2023 Bassett ..... B26B 21/225 30/527
2001/0006069 A1 * 7/2001 Treskov et al. ..... B24D 15/10 76/82
2003/0134583 A1 * 7/2003 Gallegos ..... B24B 3/60 451/349
2004/0045407 A1 * 3/2004 Katz ..... B26B 21/40 30/41
2019/0299469 A1 * 10/2019 Bassett ..... B26B 21/521

FOREIGN PATENT DOCUMENTS

GB 739532 11/1955
TW 200640610 12/2006
WO WO 2007/079756 A1 7/2007
WO WO 2012/041407 A1 4/2012

* cited by examiner

DEVICE FOR SHARPENING AND CLEANING A SHAVING DEVICE WITH A RAZOR BLADE MOUNTED IN A RAZOR BLADE UNIT

The invention relates to a device for sharpening and cleaning a shaving device with razor blades mounted in a razor blade unit, comprising a main body and a strip-shaped leather section.

Shaving device with razor blades mounted in a razor blade unit are widespread. As a rule, these are so-called "system razors" with two or more individual hardened razor blades, which are mounted partly individually resiliently in a common holding device. This holding device is referred to as a razor blade unit in the context of this invention, but is also known as a "blade block". The razor blade unit is mostly mounted pivotably about an axis, such that the razor blade unit may better follow the contour of the body part to be shaved and a better shaving result is achieved. More rarely there are also so-called "safety razors" with a rigid, i.e. non-pivotable razor blade unit. The razor blades become blunt from shaving and in the intermediate spaces between the razor blades soiling is deposited in the form of shaving residues, such as e.g. dried shaving cream and hair. The razor blade units of the system razors are therefore only recommended by their manufacturers for use for 8-12 shaves. Then, the razor blade units should be replaced. For this purpose, the razor blade units are implemented as exchangeable replaceable heads. Such an exchange of a complete razor blade unit after a comparatively short period of use is increasingly viewed as a waste of resources.

Devices for sharpening and cleaning a shaving device with razor blades mounted in a razor blade unit are therefore known from the prior art. For example, WO 2007/079756 discloses such a device that combines a conventional injection-moulded frame for storing the shaving device with a flat silicone mat which is intended to simulate the properties of human skin and in which pores are incorporated that absorb the liquid exerting its cleaning effect on the razor blade. By stroking the razor blade unit over the surface of the silicone mat, the cleaning agent is distributed over the surface of the mat. In addition, aluminium oxides with a sharpening effect can also be integrated into the silicone mat. At the same time, the razor blades of the razor blade unit are cleaned or re-sharpened. In practice, however, not very good results are achieved with this, since the liquid abrasive agents suitable for use in such a device do not have a good cleaning effect (and vice versa). In addition, the cleaning effect is only superficial; the soiling caused by dried shaving foam in the intermediate spaces between the individual blades of the razor block cannot be removed with this device.

From DE 196 45 592 C1 a device for resharpening razor blades by means of a magnetic field is known. This device is constructed in such a way that the razor blade unit comes into contact with a magnetic field generated by the device while the shaving device is being inserted into a holding device in such a way that the magnetic field lines are at a predefined angle to the surfaces of the razor blades, so that the micro-teeth of the blade cutting edges, bent by the shave, are erected or regenerated. However, this device does not solve the problem of soiling of the razor blade unit, such that—if at all—only a small service life-extending benefit is yielded from this. The same applies to other known devices for resharpening razor blades by means of so-called "sharpening leather", such as e.g. known from U.S. Pat. No. 6,062,970.

The object of the present invention is therefore to provide a device for sharpening and cleaning a shaving device with razor blades mounted in a razor blade unit, comprising a main body and a strip-shaped leather section, which distinctly extends the lifespan or service life of such a razor blade unit. Furthermore, this device should be inexpensive to manufacture and easy to handle in practical use.

According to the invention, this is achieved in that the main body additionally has a liquid reservoir that is compressible under pressure load. In this way, a generic device is provided, the main body of which has two independent components for cleaning the razor blade unit and for re-sharpening the razor blades stored therein. In the context of the invention, a liquid storage is to be understood as a storage medium which is arranged to be filled with a cleaning liquid, which holds the liquid and releases it back to the environment when it is compressed under a pressure load. The cleaning effect is achieved by placing the razor blade unit on the liquid reservoir and pressing the razor blade unit approximately vertically into the liquid reservoir. As a result of this pressure load, a liquid flow is generated in the liquid reservoir, which is opposite to the direction of the applied pressure and also extends into the intermediate spaces between the razor blades in the razor blade unit and which detects and flushes out the dirt deposits there. By increasing and decreasing compression of the liquid reservoir by means of the razor blade unit, a pressure and suction effect can be generated in the cleaning liquid in the manner according to the invention, which is propagated into the intermediate spaces between the razor blades and in these intermediate spaces causes a strong flow in alternating directions. In this way, efficient cleaning of these intermediate spaces is achieved. Since the cleaning effect is mainly caused by the mechanical flow effect of the cleaning liquid, the use of clear water as cleaning liquid, i.e. without chemical additives, is completely sufficient. This also ensures simple and unproblematic handling of the device according to the invention.

The leather section, on the other hand, is arranged for removing and resharpening the razor blades (so-called "sharpening leather"). Thus, the device according to the invention has an independent functional component both for sharpening the razor blades and for cleaning the intermediate spaces between the razor blades. By optimizing them, both the cleaning and the re-sharpening can be significantly improved and thus also a significant increase in the lifespan of the razor blades treated with this device can be achieved. The razor blades are resharpened and cleaned by the user by means of the device according to the invention before or during each shave on the leather section. This means that an almost new or completely regenerated razor blade is available for each shave. Using practical tests, it has been shown that the lifespan of the razor blades can be regularly extended to up to 3 months or around 100 applications. Ideally, the liquid reservoir and the leather section are arranged in relation to one another along the longitudinal direction of the main body in such a way that the shaving device can be alternatingly moved between the liquid reservoir and the leather section with an homogeneous hand movement of the user (i.e. without putting the hand down, reaching around or changing the direction of the hand movement). This facilitates the use of the device and speeds up the cleaning and resharpening procedure. Both the liquid reservoir and the leather section have a minimum width which corresponds to the width of commercially available razor blade units.

The main body is also very easy to manufacture, for example by milling the depressions into a cuboid block of wood or by injection moulding.

According to a first preferred embodiment of the invention, the liquid reservoir is designed as a sponge-like foam or fleece with anisotropic liquid conductivity. With such anisotropic liquid conductivity is in this context understood to mean that the transport of the liquid droplets through the structural components of the foam or fleece takes place more easily in a first spatial direction than in a second spatial direction deviating thereof. In a preferred manner, foam or fleece are arranged in the device according to the invention in such a way that this first direction (with good liquid conductivity) is aligned parallel to the direction of the pressure load when the device is used as intended. In this way, the generation of the liquid flow in the foam or fleece is improved under pressure load and thus effectively supports the cleaning effect of the device according to the invention.

The main body has a preferably cuboid recess for receiving the liquid reservoir. This cuboid shape of the recess ensures a sufficient size of the liquid reservoir such that it remains ready for use over a longer period of time, but at least for a complete shaving process without refilling with cleaning liquid.

According to a further preferred embodiment of the invention, the main body has a strip-shaped recess for receiving the leather section, which is convexly arched along at least one spatial direction. This facilitates the manual guiding of the razor blade unit over the leather section. At the same time, the contact between the leather section (or sharpening leather) and the razor blades is improved. Through the increased pressure action on the razor blades during the manual guiding of the razor blade unit over the convex bulge, an improved sharpening effect is produced on the cutting edges of the razor blades and the usability of the device according to the invention is significantly improved. This bulge can run both along the longitudinal direction of the main body, but also along the transverse direction of the main body. An embodiment with a convex bulge in both spatial directions is preferred. Regardless of the direction in which it extends, the apex of the at least one convex bulge lies in the middle section of the leather strip. With regard to the inventive concept, it has the same effect if the convex bulge is achieved either by a corresponding shaping of the leather section or a corresponding shaping of the main body at the bottom of the recess.

According to a further preferred embodiment of the invention, the main body has lateral guide elements, which are arranged to guide the razor blade unit and are aligned parallel to the longitudinal extension of the leather section. This facilitates the manual guiding of the razor device during the linear movement of the razor device over the leather section. The guide elements can preferably be formed as such by the vertical delimiting surfaces of the strip-shaped recess, which enables the device according to the invention to be manufactured in a particularly simple manner. As an alternative to this, however, independent guide rails may also be provided, which are provided along the longitudinal direction of the main body parallel to the strip-shaped recess on the surface of the main body. This is particularly useful if the recess for receiving the leather section is dimensioned only in a small way.

In a particularly advantageous manner, the main body has a receptacle for storing the shaving device. In this way, the device according to the invention can also be used for storing the shaving device and is quickly at hand when the shaving device is used.

This is effectively supported by the fact that the receptacle for storing the shaving device consists of a wedge-shaped depression in the main body and at least one magnet. In this way, the shaving device can be brought into connection quickly and easily with the device according to the invention. The depression in the main body enables a comparatively low overall height of the device according to the invention, even together with a shaving device located in the receptacle.

For this purpose, the at least one magnet can be completely or partially sunk into the main body, such that it does not result in any interfering protrusions. The at least one magnet can be arranged in the area of the wedge-shaped depression in the main body (and enable the razor blade unit of the shaving device to be held there), but also in a position spaced therefrom in the longitudinal direction of the main body (and enable the handle of the shaving device to be held there). It is also possible to combine a plurality of such magnets.

It has also proven to be particularly advantageous when the recess for receiving the liquid reservoir and the recess for receiving the leather section are arranged in series with one another on a common first side of the main body and in the longitudinal direction of the main body. This facilitates the alternating manual control of the liquid reservoir and leather section and enables a particularly simple handling of the device. The cleaning as well as the sharpening components of the device can be reached with almost the same hand movement.

In a particularly useful way, the receptacle for storing the shaving device is arranged on a second side opposite to the first side (or "backside") of the main body.

The present invention is explained in more detail below on the basis of an exemplary embodiment and the associated drawings.

FIG. 1: shows a perspective view of the first side of the main body (1) with liquid reservoir (2) and leather section (4)

Figure 2:
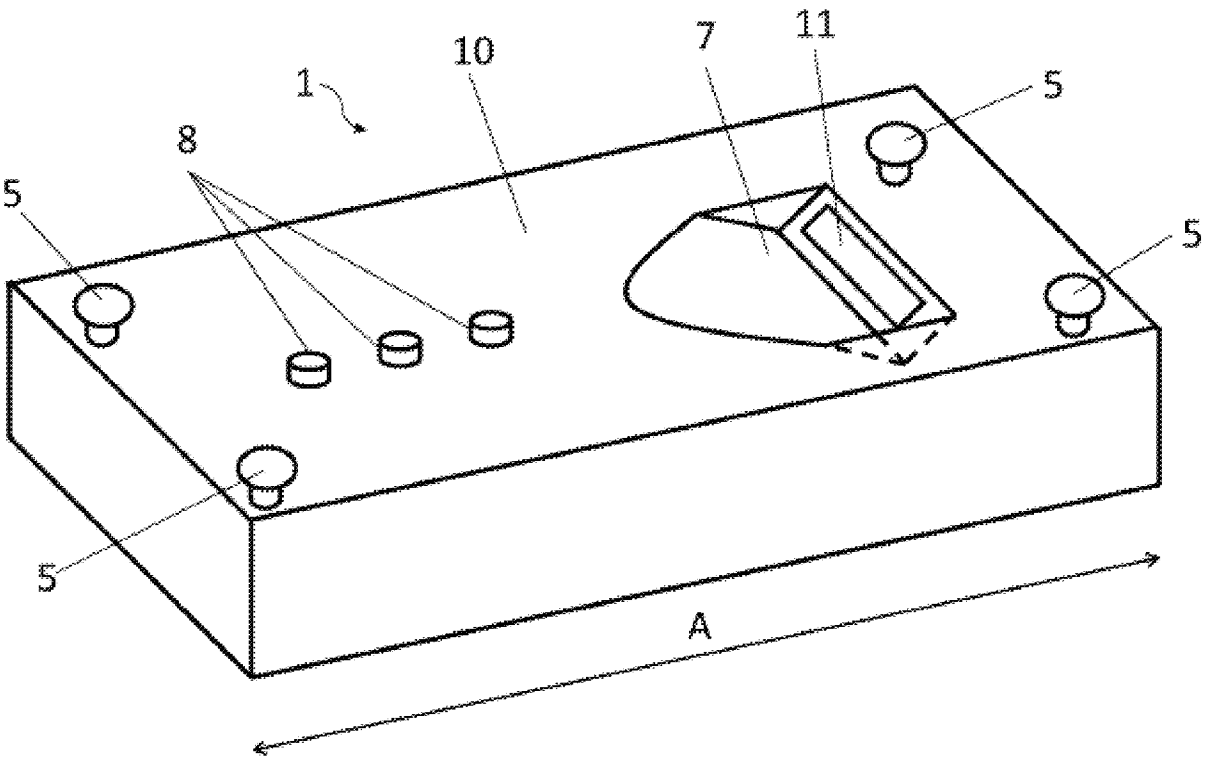

FIG. 2: shows a perspective view of the second side of the main body (1) with the receptacle (7) for storing a shaving device.

FIG. 1 shows a perspective view of the first side of the main body (1) with liquid reservoir (2) and leather section (4). This first side can also be understood as the "top" of the main body. The main body is made in one piece from wood (alternatively, it could also be made from plastic, ceramic or metal) and has a length along a first longitudinal direction (A) of approximately 200 mm, a width of approximately 80 mm and a height of approximately 25 mm. A rectangular recess (3) for receiving the liquid reservoir (2) and a strip-shaped recess (6) for receiving the leather section (4) are incorporated into the main body (1). The recess (3) has a length of approximately 20 mm and a width of approximately 45 mm along a first longitudinal direction (A). The liquid reservoir (2) is formed as a sponge-like cuboid foam element, the structure and material of which is realised in such a way that under pressure load, it releases the stored liquid in a direction opposite to the direction of pressure introduction, whereby a liquid flow is formed. If the pressure load takes place by means of a razor blade unit placed on the foam element, then this liquid flow also covers the intermediate spaces between the blades of the razor blade unit. The base of the recess (6) for receiving the leather section (4) has a convex bulge, the highest point or apex thereof being arranged in an approximately central region of the recess (along the longitudinal extent of the main body). The convex bulge is realized both along the longitudinal direction (A) and along a transverse direction perpendicular thereto; i.e. the leather section (4) is convexly arched in two mutually perpendicular spatial directions. According to an alternative embodiment, a convexly arched leather section is inserted into a flat recess. The recess (6) has a length of approximately 80 mm and a width of approximately 30 mm along a first longitudinal direction (A). In addition, the recess (6) has vertical guide elements (13) and horizontal guide elements (14) on both sides of the leather section (4), which support and facilitate the manual guiding of a razor blade unit over the leather section. The moisture reservoir and the leather section are arranged in series with one another in the longitudinal direction (A) of the main body, which simplifies the alternating manual control of the liquid reservoir (2) and the leather section (4). In addition, a drainage channel (12), sunk into the main body, is arranged between the moisture reservoir and the leather section, which allows excess liquid to be drained away from the liquid reservoir and to be transferred into the recess of the leather section. Should the liquid reservoir accidentally have been filled with too much liquid, then this liquid does not run away sideways in an uncontrolled manner under the pressure load of a razor blade unit placed on the liquid reservoir for cleaning, but is collected in the recess (6) and can then be dumped out of there later in a controlled manner. Rubber buffers (5) or rubber pads are arranged on all four corners of the main body (1), which make it easier to place the main body on a hard surface and which avoid slipping during use.

FIG. 2 shows a perspective view of the second side of the main body (1) with the receptacle (7) for storing a shaving device. This second side can also be understood as the "bottom" or "backside" of the main body. However, as soon as the main body (1) is in a storage position that stores a shaving device, this second side of the main body is on top. The receptacle (7) is deepened into the main body in an approximately wedge-shaped manner and is used to store the razor blade unit of a conventional system razor or wet shaving device. Three magnets (8), which serve to fix the handle of the shaving device, are arranged at different distances from this along a line running approximately parallel to the longitudinal direction of the main body. In addition, a magnet (11) for holding the razor blade unit is also located in the area of the wedge-shaped receptacle (7). Also on the bottom, rubber buffers (5) or rubber pads are arranged on all four corners of the main body (1), which make it easier to place the main body on a hard surface and which avoid slipping during use.

LIST OF REFERENCE NUMERALS

1 Main body
2 Liquid storage
3 Recess for liquid storage
4 Leather section
5 Rubber buffer
6 Recess for leather section
7 Wedge-shaped receptacle-depression
8 Magnet
9 First side ("top")
10 Second side ("bottom"/"backside")
11 Magnet
12 Drainage channel
13 Vertical guide element
14 Horizontal guide element
A Longitudinal direction of the main body

The invention claimed is:

1. A device for sharpening and cleaning a shaving device with razor blades mounted in a razor blade unit, comprising:
- a main body having a first external surface, the first external surface having a first edge and a second edge spaced from each other in a first direction and a third edge and a fourth edge spaced from each other in a second direction;
- a first recess and a second recess in the first external surface, each of the first recess and second recess having an upper edge in the first external surface;
- a strip-shaped leather section in the first recess; and
- a liquid reservoir that is compressible under pressure load in the second recess, the liquid reservoir extending below the first external surface,
- wherein the liquid reservoir and the leather section are arranged on the first external surface of the main body and spaced from each other in the first direction.

2. The device for sharpening and cleaning a shaving device according to claim 1, wherein the liquid reservoir is formed as a sponge-like foam with anisotropic liquid conductivity.

3. The device for sharpening and cleaning a shaving device according to claim 2, wherein the first recess is convexly arched along at least one spatial direction.

4. The device for sharpening and cleaning a shaving device according to claim 2, wherein the main body has lateral guide elements which are designed to guide the razor blade unit and are aligned parallel to a longitudinal extension of the leather section.

5. The device for sharpening and cleaning a shaving device according to claim 2, wherein the main body has a receptacle for storing the shaving device.

6. The device for sharpening and cleaning a shaving device according to claim 1, wherein the first recess is convexly arched along at least one spatial direction.

7. The device for sharpening and cleaning a shaving device according to claim 6, wherein the main body has lateral guide elements which are designed to guide the razor blade unit and are aligned parallel to a longitudinal extension of the leather section.

8. The device for sharpening and cleaning a shaving device according to claim 6, wherein the main body has a receptacle for storing the shaving device.

9. The device for sharpening and cleaning a shaving device according to claim 1, wherein the main body has lateral guide elements which are designed to guide the razor blade unit and are aligned parallel to a longitudinal extension of the leather section.

10. The device for sharpening and cleaning a shaving device according to claim 9, wherein the main body has a receptacle for storing the shaving device.

11. The device for sharpening and cleaning a shaving device according to claim 1, wherein the main body has a receptacle for storing the shaving device.

12. The device for sharpening and cleaning a shaving device according to claim 11, wherein the receptacle for storing the shaving device consists of a wedge-shaped depression in the main body and at least one magnet.

13. The device for sharpening and cleaning a shaving device according to claim 12, wherein the receptacle for storing the shaving device is arranged on a second side of the main body opposite to the first external surface.

14. The device for sharpening and cleaning a shaving device according to claim 1, further comprising a drainage channel between the reservoir and the leather section.

15. The device for sharpening and cleaning a shaving device according to claim 1, wherein edges of the first recess are spaced from edges of the first external surface.

16. The device for sharpening and cleaning a shaving device according to claim 1, wherein edges of the second recess are spaced from edges of the first external surface.

17. The device for sharpening and cleaning a shaving device according to claim 1, wherein edges of the first recess are spaced from each of the first edge, second edge, third edge and fourth edge of the first external surface, and wherein edges of the second recess are spaced from each of the first edge, second edge, third edge and fourth edge of the first external surface.

18. The device for sharpening and cleaning a shaving device according to claim 1, wherein a top surface of the leather section is below the first external surface.

19. The device for sharpening and cleaning a shaving device according to claim 18, wherein vertical guide elements extend along a first edge and a second edge of the first recess.

20. The device for sharpening and cleaning a shaving device according to claim 18, wherein a sloping surface extends from each of a third edge and a fourth edge of the first recess to the leather section.

* * * * *